US007775916B1

(12) United States Patent
Mahoney

(10) Patent No.: US 7,775,916 B1
(45) Date of Patent: Aug. 17, 2010

(54) SOCCER GOAL STRUCTURE

(76) Inventor: Thomas Henry Mahoney, 217 Albion, Dorrance, KS (US) 67364

( * ) Notice: Subject to any disclaimer, the term of this patent is extended or adjusted under 35 U.S.C. 154(b) by 0 days.

(21) Appl. No.: 12/381,186

(22) Filed: Mar. 9, 2009

Related U.S. Application Data

(63) Continuation of application No. 11/498,466, filed on Aug. 3, 2006, now abandoned.

(60) Provisional application No. 60/706,196, filed on Aug. 5, 2005.

(51) Int. Cl.
*A63B 63/00* (2006.01)

(52) U.S. Cl. ..... 473/478; 403/292

(58) Field of Classification Search ..... 473/478, 473/430; 16/341; 135/137, 157; 403/14, 403/194, 202, 298, 292
See application file for complete search history.

(56) References Cited

U.S. PATENT DOCUMENTS 1,188,485 A * 6/1916 Pruyn ..... 285/27
2,077,343 A * 4/1937 Oakes et al. ..... 473/478
4,013,372 A * 3/1977 Lay et al. ..... 403/237
4,238,117 A * 12/1980 Newman ..... 256/65.1
4,611,945 A * 9/1986 Diego ..... 403/61
5,048,844 A * 9/1991 Haseltine ..... 273/400
5,080,375 A * 1/1992 Moosavi ..... 473/478
5,842,939 A * 12/1998 Pui et al. ..... 473/478
5,865,691 A * 2/1999 Chen ..... 473/416
7,074,141 B2 * 7/2006 Bryant et al. ..... 473/478
7,300,059 B2 * 11/2007 Caruso ..... 273/400
2004/0072633 A1 * 4/2004 Webb ..... 473/478

* cited by examiner

*Primary Examiner*—Gene Kim
*Assistant Examiner*—M Chambers
(74) *Attorney, Agent, or Firm*—Robert O. Blinn

(57) ABSTRACT

The present invention is a system for joining tubes in a structure. The system includes hollow tubes and pressure assemblies. The tubes have tool holes spaced from the ends which are to be joined together. The pressure assemblies include members which can be spread apart by threaded inserts threaded into one of the members. The threaded inserts are spaced to correspond to the spacing between the tool holes as occurs when the tube ends are placed together. Accordingly, a pressure assembly can be inserted into adjacent tube ends and then expanded with sufficient expanding force for joining the tube ends in a rigid, strong joint. The system of the present invention may be used to make highly versatile and portable structures such as soccer goals, American football uprights and basketball goals.

8 Claims, 8 Drawing Sheets

SOCCER GOAL STRUCTURE

CROSS REFERENCES TO RELATED APPLICATIONS

This application is a continuation of U.S. application Ser. No. 11/498,466 filed on Aug. 3, 2006. U.S. application Ser. No. 11/498,466 claimed the benefit of U.S. Provisional Application No. 60/706,196 filed on Aug. 5, 2005.

FIELD OF THE INVENTION

The present invention relates to a system for connecting adjoining ends of open ended tubes.

BACKGROUND OF THE INVENTION

Various types of structures include generally cylindrical tubular members. It is often a requirement of such structures that at least a portion of the outside surface of a tube member present a generally smooth cylindrical surface. For example, in the area of structures used in sporting contests, the horizontal and upright members of an American football goal should preferably present smooth surfaces. The same is true for a soccer goal. Smooth cylindrical surfaces are required to either deflect a ball away from the goal or into the goal in a predictable manner. Another consideration for such structures is that load bearing members should remain substantially straight and have no significant deflection. This requirement may be present for a wide range of structures, even structures which do not require smooth, cylindrical surfaces. This requirement for limited deflection leads designers to use long, straight, strong and uninterrupted members which are free of joints. Yet, a structure is much easier to transport and use if it is possible to disassemble the structure. This is particularly the case for structures having long straight members. Yet another consideration for structures of various types and particularly for soccer goals, is that it is desirable to combine members of different lengths to make structures of different sizes. When tubular members are joined to make longer segments, segments of different lengths may be used to make structures of different sizes. This would be particularly advantageous in the case of soccer goals which are constructed to conform to a series of regulation sizes for various age groups. Accordingly, what is needed is a system for joining tubular members which can be used to join relatively short lengths of structural tubing in a manner which provides strong and rigid joints and which. In the case of structures for sporting contests, a joining system is also needed to provide joints which present smooth surfaces for those portions of a joint that are in play in a contest. And also, particularly in the case of structures for sporting contest, a joining system is needed for making structures of various sizes.

BRIEF DESCRIPTION OF THE INVENTION

In an embodiment of the present invention the aforementioned needs are addressed by a tube joining system for rigidly connecting adjoining ends of two open ended tubes. A joint made according to the present system includes two tubes for joining together at respective end surfaces and an expanding pressure assembly. The tubes preferably include two generally equally sized cylindrical tubes. Each tube presents an open joint end defined by an joint end surface which is preferably generally normal to the axis of the tube. Each tube has at least one tool hole bored in its wall which is spaced away from the joint end surface. If the joint end surfaces of the two tubes are brought together, the tool holes of the respective tubes are separated from each other by a tool hole separation distance. The pressure assembly is adapted for insertion into and between the joint ends of the tubes and for expansion within the adjacent tube ends to effect a strong and generally rigid connection. The pressure assembly includes a first pressure portion and a second pressure portion. The first pressure portion includes a first pressure member which presents at least one longitudinal pressure surfaces. The second pressure portion includes a second pressure member which also presents at least one longitudinal pressure surface. The second pressure member has two spaced threaded openings which are oriented generally normally to the second pressure member. The threaded openings are spaced to align with the tool holes in the walls of the tubes when the tubes are joined together. The threaded openings of the second pressure portion each receive a threaded insert. The threaded inserts, when rotated, push against the first pressure portion such that the pressure assembly may be adjusted between a first contracted position and a second expanded position by rotating the threaded inserts. When in the first contracted position, the pressure assembly can be inserted into the adjacent ends of the tubes such that the two threaded openings and the threaded inserts generally align with the tool holes of the tubes. Once the pressure assembly and the tube ends are thus aligned, the threaded inserts can be accessed through the tool holes of the tube and rotated to cause the pressure assembly to expand toward the second expanded position. As the pressure assembly expands, the longitudinal pressure surfaces of the first and second pressure members contact and push against the inside walls of the adjoining tubes with increasing pressure until the ends of the tubes are generally rigidly joined to make a substantially straight, continuous tube section.

DETAILED DESCRIPTION

Figure 1:
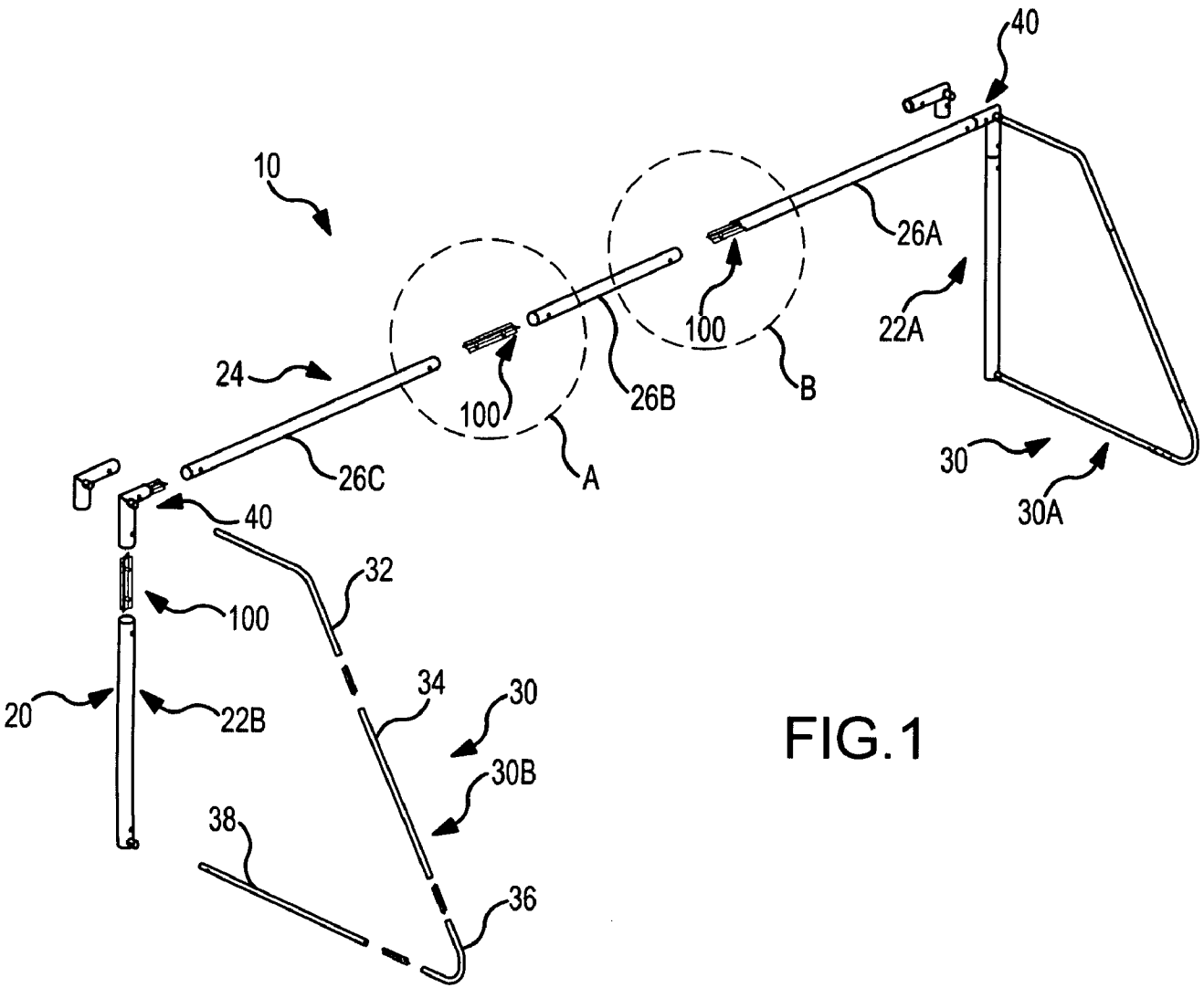
FIG. 1 is a perspective view of a soccer goal structure constructed using the tube joining system of the present invention showing one end of the structure assembled and the remaining portions of the goal structure exploded.

Referring to the drawings, FIG. 1 shows a soccer goal structure 10 which is assembled using tubes and pressure assemblies of the present invention. The skilled reader should understand that soccer goal structure 10 shown in FIG. 1 is an embodiment of one way to apply the present invention. Accordingly, a soccer goal structure which employ the tube joining system of the present invention may be thought of as one specie of this invention. The skilled reader should also understand that soccer goal 10 is merely one example of a structure that may be assembled using the tube joining system of the present invention. The tube joining system of the present invention may be used to construct a myriad of different structures. Just a few examples of such structures might include scaffolding systems, basket ball goal support members, American football uprights and batting cages.

Soccer goal structure 10 shown in FIG. 1 generally includes a forward frame portion 20 and a rear support portion 30. Rear support portion 30 is further divided into a right support brace 30A and a left support brace 30B. For simplicity, right support brace 30A and left support brace 30B should be considered as identical structures. Forward frame portion 20 further includes a right upright member 22A, a left upright member 22B and a horizontal member 24. Horizontal member 24 is further divided using the joining system of the present invention. The various components of horizontal member 24 and the joints between the various other members noted here will be described in greater detail below. Horizontal member 24 is joined at the right and left ends to upright members 22A and 22B by corner joints 40. Corner joints 40 will be described in greater detail below.

A more detailed understanding of the tube joining system can be better understood with reference to FIGS. 1, 2A, 2B and 3. FIGS. 1, 2A, 2B and 3 together illustrate how three tube sections can be joined to form a single rigid length of tube for use as a horizontal member of a soccer goal structure. As can be seen in FIG. 1, with this capability, it becomes generally possible to break down soccer goal structure 10 for storage in a relatively small space or for transportation or shipping within a relatively small volumes. Moreover, with this joining system, it becomes possible to interchange the various lengths of tube of goal structure 10 in order to change the dimensions of the opening at the front of a soccer goal. This is an important capability because soccer goals range through a set of standard, regulation sizes for use by various age groups up to and including full sized soccer goals as used by, for example, universities and professional leagues. Soccer leagues which serve more than one age group may take advantage of the versatility allowed by interchangeable tubes of varying lengths. Thus, horizontal member 24 is shown in FIG. 1 to include a right end tube section 26A, a center tube section 26B and a left end tube section 26C.

Figures 2A, 2B:
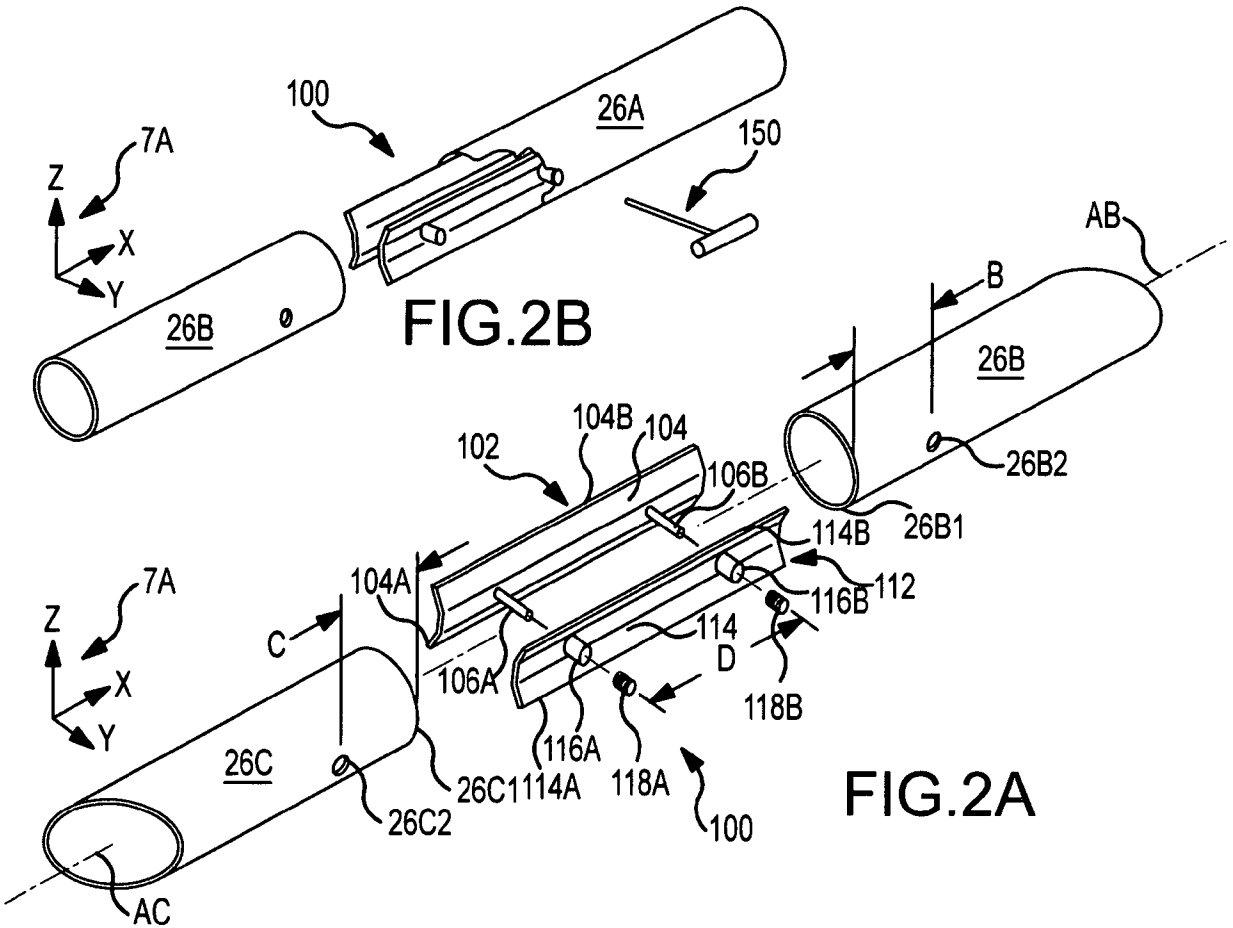
FIG. 2A is a magnified perspective view of a tube joint taken from zone A of FIG. 1.
FIG. 2B is a less magnified perspective view of a tube joint taken from zone B of FIG. 1.

FIG. 2A provides a detailed illustration of the joint between center tube section 26B and left end tube section 26C of horizontal member 24. This joint is an embodiment of the joint system intended for joining relatively large diameter tube sections. Here, the joint system includes tube sections 26B and 26C as well as a pressure assembly 100. Pressure assembly 100 will be described in greater detail below. Tube sections 26B and 26C present open ends having end surfaces 26B1 and 26C1 which are generally compatibly sized and shaped with respect to each other and normal to the longitudinal axis AB and AC of each respective tube section. Spaced away from the end of each tube section 26B and 26C are tool holes 26B2 and 26C2. As shown in FIG. 2A, tool hole 26B2 is spaced away from end surface 26B1 by a distance B. Similarly, tool hole 26C2 is spaced away from end surface 26C1 by a distance C. Tube sections 26B and 26C may be fashioned from any suitable generally strong light material. Aluminum is a preferred material for structural tubes for soccer goals.

Figure 3:
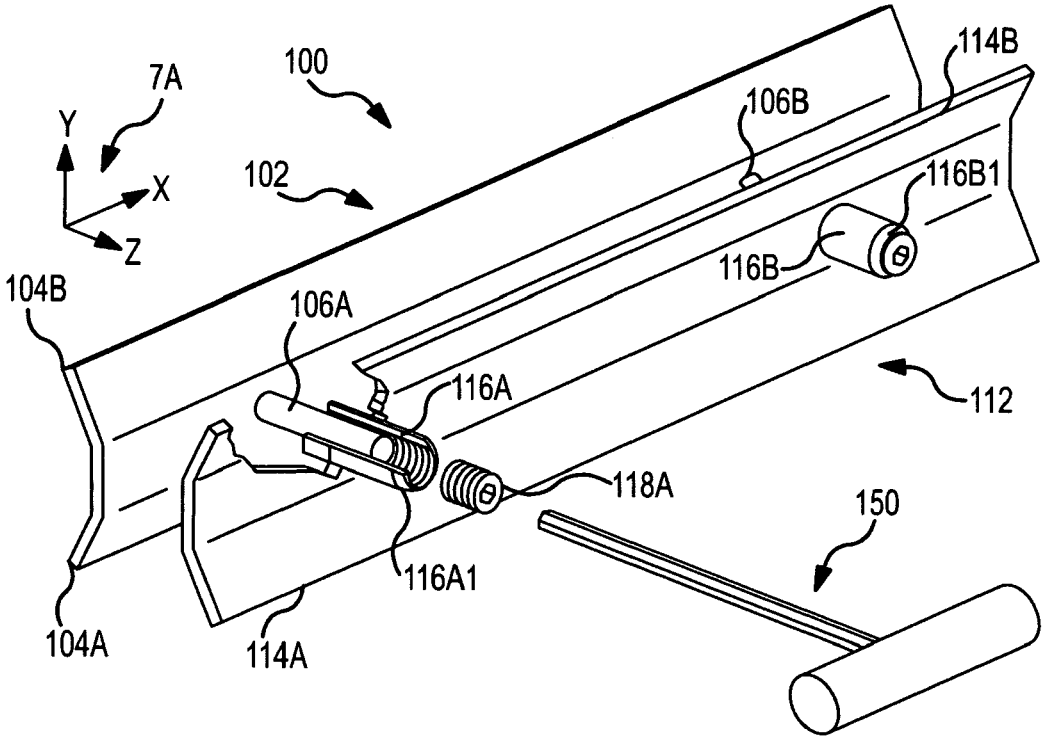
FIG. 3 is a magnified, partially cut away perspective view of the pressure assembly of the type shown in FIGS. 2A and 2B used for joining portions of the relatively large diameter upright and horizontal members at the front of the goal structure.

Pressure assembly 100 can be best understood by referring to FIG. 2A and FIG. 3. FIG. 3 provides a magnified, partially cut away view of pressure assembly 100. Pressure assembly 100 is designed for insertion into the adjoining ends of tube sections 26B and 26C and then for expansion to apply internal pressure against the inside walls of tube sections 26B and 26C to effect a rigid joint between them. Pressure assembly 100 includes a first pressure portion 102 and a second pressure portion 112. First pressure portion 102 includes a first pressure member 104 which is formed into a flattened channel shape for presenting a first pressure surface 104A (which is mostly hidden in FIG. 2A) and a second pressure surface 104B. Pressure member 104 may be considered as having a center flange 104D and two obtusely angled side flanges 104E and 104F extending from center flange 104D. The combination of these flanges provides a member which may yield slightly under pressure for effecting an expanding force for joining tube sections 26B and 26C. Two pins 106A and 106B extend generally normally from pressure member 104 and are spaced in accordance with distance D. Distance D generally corresponds to the sum of distances B and C described above. The relationship between distance D and distances B and C will be discussed in greater detail below.

Second pressure portion 112 is designed to fit together with first pressure portion 102. Like first pressure portion 102, second pressure portion 112 includes a second pressure member 114 which is shaped to define a generally flattened channel which presents first and second pressure surfaces 114A and 114B. Pressure member 114 may be considered as having a center flange 114D and two obtusely angled side flanges 114E and 114F extending from center flange 114D. As with first pressure member 104 above, the combination of these flanges provides a member which may yield slightly under pressure for effecting an expanding force for joining tube sections 26B and 26C. Second pressure portion 112 has two internally threaded collars 116A and 116B which are sized and spaced apart to receive pins 106A and 106B. Pins 106A and 106B do not have external threads for engaging the internal threads of collars 116A and 116B. Rather, pins 106A and 106B are preferably smooth and are intended to move freely within of collars 116A and 116B. The spacing of collars 116A and 116B is also generally consistent with distance D which generally corresponds to the sum of distances B and C as noted above. Collars 116A and 116B receive threaded inserts 118A and 118B As can be best seen in FIG. 3, collars 116A and 116B freely receive pins 106A and 106B. Threaded inserts 118A and 118B can be rotated counter clockwise by Allen wrench 150 (as seen in FIG. 3) to retract inserts 118A and 118B to allow pins 106A and 106B to penetrate collars 116A and 116B. Conversely, threaded inserts 118A and 118B can be rotated clockwise by allen wrench 150 to extend inserts 118A and 118B for forcing pins 106A and 106B away from second pressure member 112. Accordingly, by rotating inserts 118A and 118B with allen wrench 150, the overall width of pressure assembly 100 may be adjusted between a first contracted position and a second expanded position. When pressure assembly 100 is in the first contracted position, it may be easily inserted into the ends of adjacent tube sections 26B and 26C. When pressure assembly 100 is in the second expanded position, and if pressure assembly 100 has been previously inserted into the adjacent ends of tube sections 26B and 26C as shown in FIG. 2C, then pressure surfaces 104A, 104B, 114A and 104B are forced against the inside walls of adjacent tube sections 26B and 26B effecting a rigid joint between them.

The spacing of tool holes 26B2 and 26C2 and the relative spacing of threaded collars 116A and 116B must be executed properly in order to make a joint according to this embodiment of the invention. Generally, tool holes 26B2 and 26C2 need to be spaced and sized such that threaded inserts 118A and 118B can be accessed by allen wrench 150. If tool holes 26B2 and 26C2 can be precisely located in relation to their respective tube section ends, and if internally threaded collars 116A and 116B are also precisely located, then collars 116A and 116B can be adapted to extend out through tool holes 26B2 and 26C2 thus further locking tube sections 26B and 26C in a longitudinal direction. In FIG. 3, collars 116A and 116B are shown to have beveled surfaces 116A1 and 116B1. These beveled surfaces 116A1 and 116A2 are adapted for seating in tool holes 26B2 and 26C2. If tool holes 26B2 and 26C2 are more widely spaced than collars 116A and 116B by a very small amount (that is if the sum of distances C and B is slightly larger than distance D), then beveled surfaces 116A1 and 116A2 can act to push tubes 26B and 26C together as pressure assembly 100 is expanded. A corresponding pin and hole arrangement may also be placed on the opposite sides of tube sections 26B and 26C and pressure assembly 100 in order to apply a compressive longitudinal force on the other side of the joint. Such a corresponding, opposite pin hole arrangement is not employed in this embodiment because it is preferable for goal frame sections to present smooth front surfaces.

The radial spacing of pressure surfaces 104A, 104B of pressure member 104 and pressure surfaces 114A and 114B of pressure member 114 is preferably arranged such that a pressure surface, which in this embodiment is a relatively narrow edge, contacts the inside walls of the joined tube sections approximately every 90 degrees. This spacing is intended to evenly distribute the pressure applied by these elements. As noted above, the shape used for pressure members 104 and 114 allows a very small amount of deflection for aiding in the joining of the tube sections.

Figure 2C:
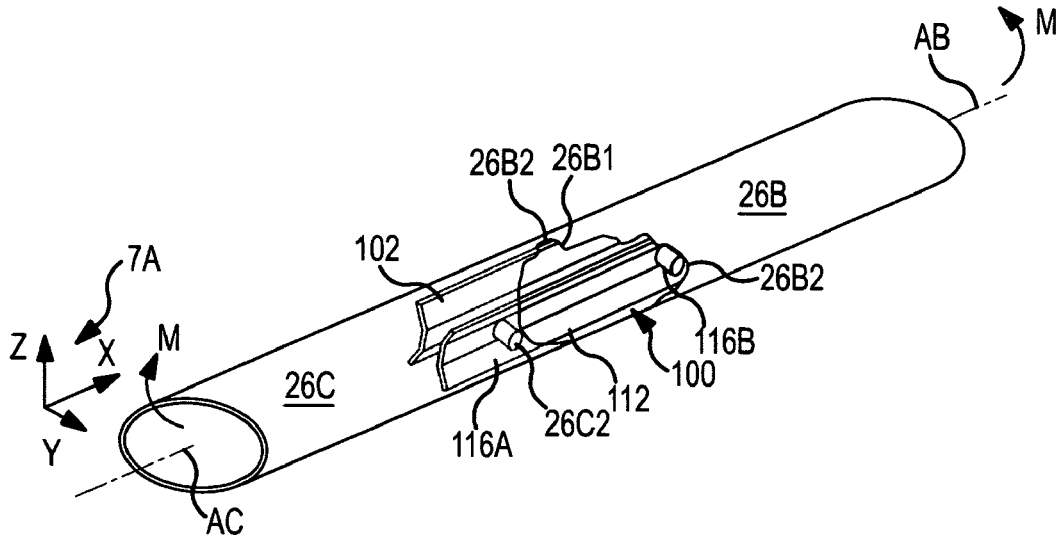
FIG. 2C is a magnified perspective view of a tube shown in FIG. 2A with the tube sections assembled with an expansion assembly.

The orientation of tool holes 26B2 and 26C2 and pressure assembly 100 as shown in FIGS. 1-3 is arranged to increase the bending resistance of a pressure assembly joint for horizontal sections. Orientation axis 7A shown in FIGS. 2A-3 is intended to show the conventional orientation of pressure assembly 100 and tool holes 26B2 and 26C2 within a typical joint. The positive X direction is right as perceived by a goalie, the positive Y direction is into the goal and the positive Z direction is up. Thus, FIGS. 1-3 provide the preferred orientation for a tube section joint for joining generally horizontal sections of tubes. With this preferred orientation, pressure members 104 and 114 are maintained in a generally upright orientation with pins 106A and 106B in a generally horizontal orientation. Those skilled in the art will appreciate that pressure members 104 and 114 have a greater capacity to resist a bending moment M (shown in FIG. 2C) which is oriented about the y axis of axis system 7A. This is the case if pressure members 104 and 114 are generally oriented parallel to the XZ plane as given in axis system 7A. Accordingly, when in this orientation, pressure assembly 100 when expanded within adjacent tube sections provides a stronger joint for joined sections which are oriented generally horizontally as shown in FIG. 1. Because pressure assembly 100 is designed to encounter significant stresses, it is preferable to fabricate pressure assembly 100 from high tough, high strength materials such as steel.

As noted above, another advantage of using this system for joining tube sections is that forward frame portion 20 of goal structure 10 may be configured to accommodate a number of different standard goal sizes. The width of goal structure 10 can be adjusted by (a) replacing center tube section 26B of horizontal member 24 with tub sections of varying lengths and (b) eliminating center tube section 26B and one of pressure assemblies 100 to join tube section 26A directly to tube section 26C. The height of goal structure 10 can be adjusted by replacing upright members 22A and 22B with shorter member. The height and width of goal structure 10 may be simultaneously adjusted by rotating corner fittings 40 as shown in FIG. 1. If the dimensions of all of these components are carefully chosen, then many if not substantially all of the standard goal sizes can be accommodated by a relatively small number of part numbers. It also should be noted that as the height of goal structure 10 is adjusted, the diagonal sections of left and right support braces 30A and 30B must also be replaced with sections having different lengths.

Figure 4:
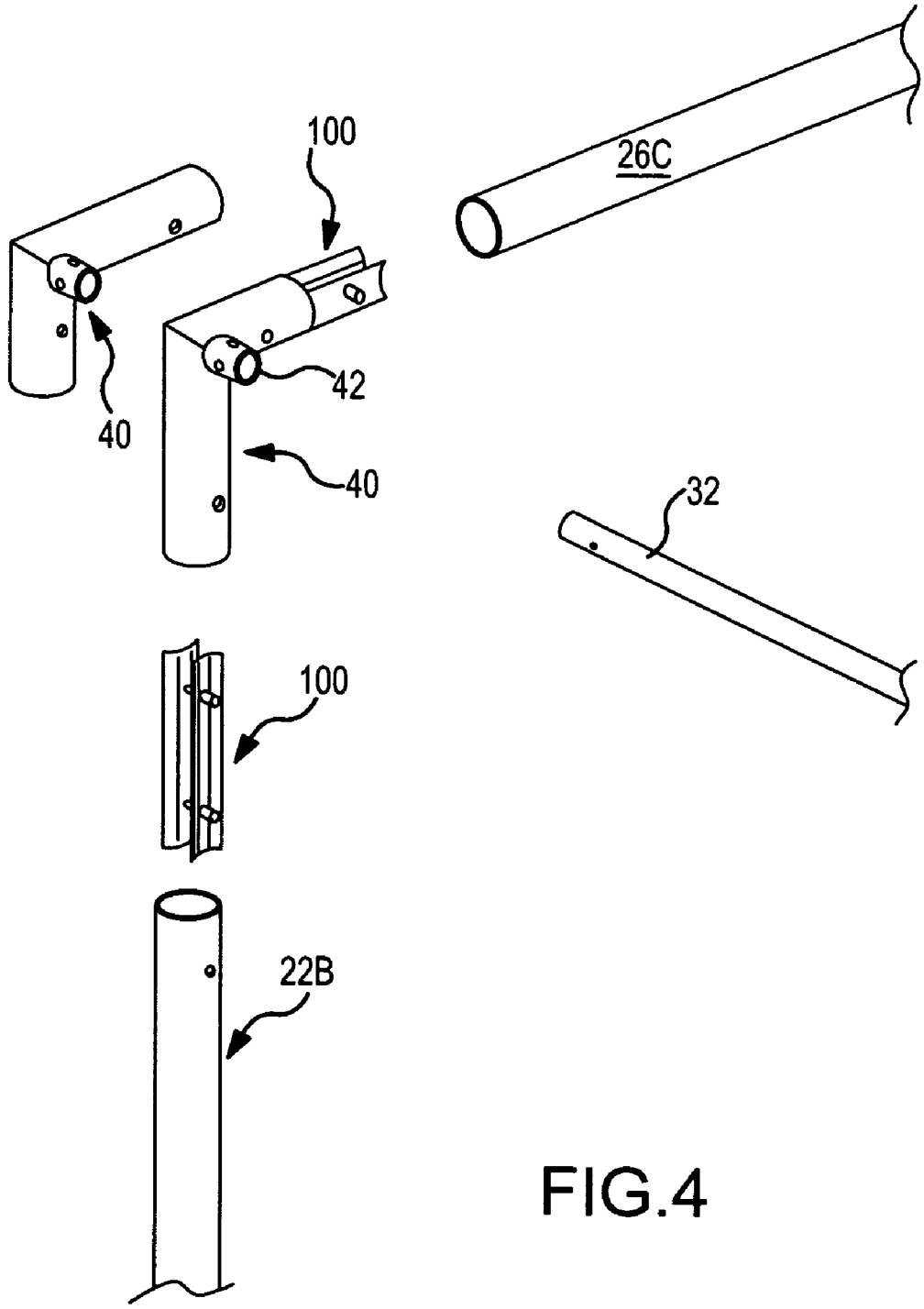
FIG. 4 is a magnified view of the exploded end of the soccer goal structure shown in FIG. 1 showing the corner for joining one end of the horizontal goal member, the upper end of the upright side goal member and the upper horizontal portion of the rear support structure.

FIG. 4 provides a magnified view of the left upper corner of goal structure 10 shown in FIG. 1. As can be seen in FIG. 4, an upper member 32 of support brace 30B is pinned in a conventional manner to a connecting collar 42 of corner fitting 40. Connecting collar 42 includes vertical and horizontal sets of pin holes so that a connection can be made even if corner fitting 40 is rotated to adjust goal height and width as shown in FIGS. 1 and 4. The joined tube sections of corner fitting 40 are of the same diameter as other tube sections so that, when corner fittings 40 are combined with pressure assemblies 100, smooth joints can be made at each corner of the goal.

Figures 5A, 5B:
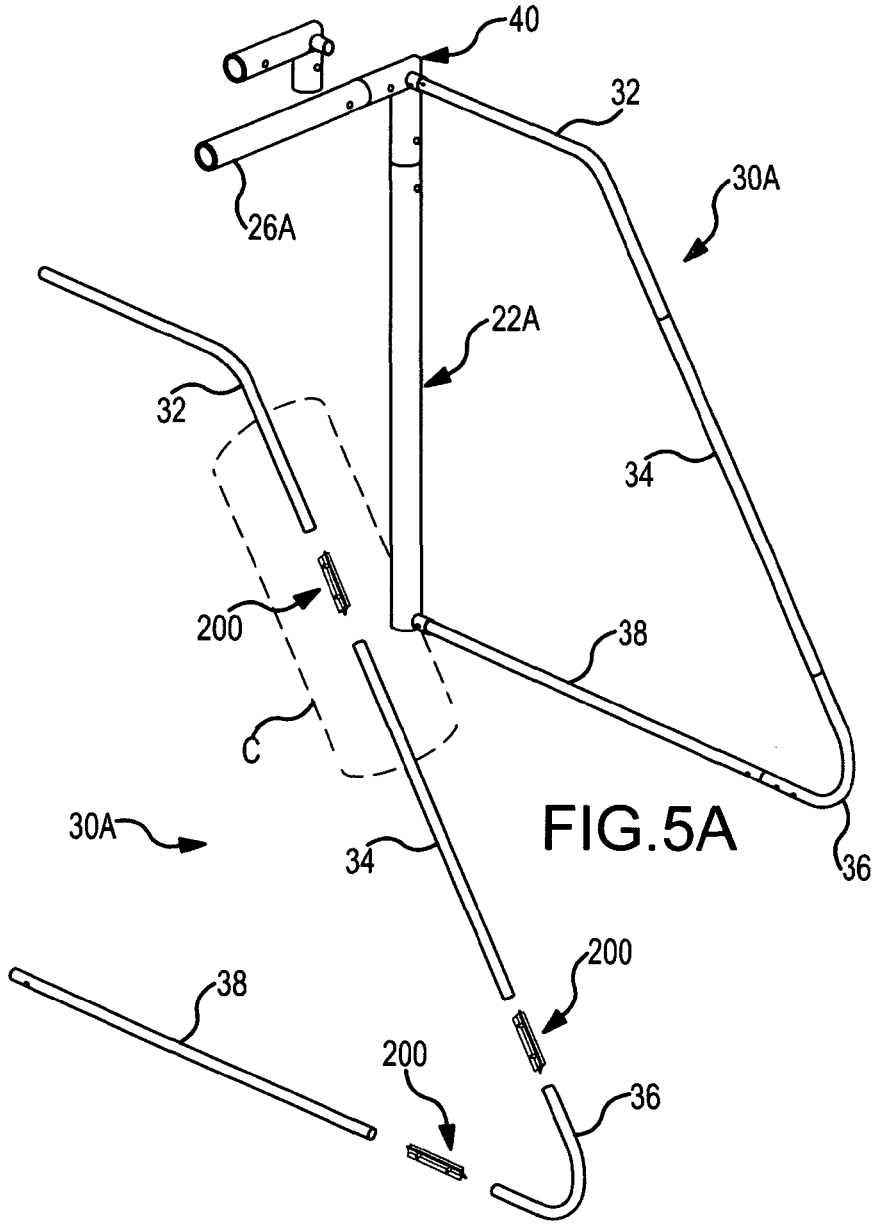
FIG. 5A is a magnified view of the assembled right end of the soccer goal structure shown in FIG. 1.
FIG. 5B is an exploded view of the rear support brace portion of assembled end of the soccer goal structure shown in FIG. 1.
Figure 6:
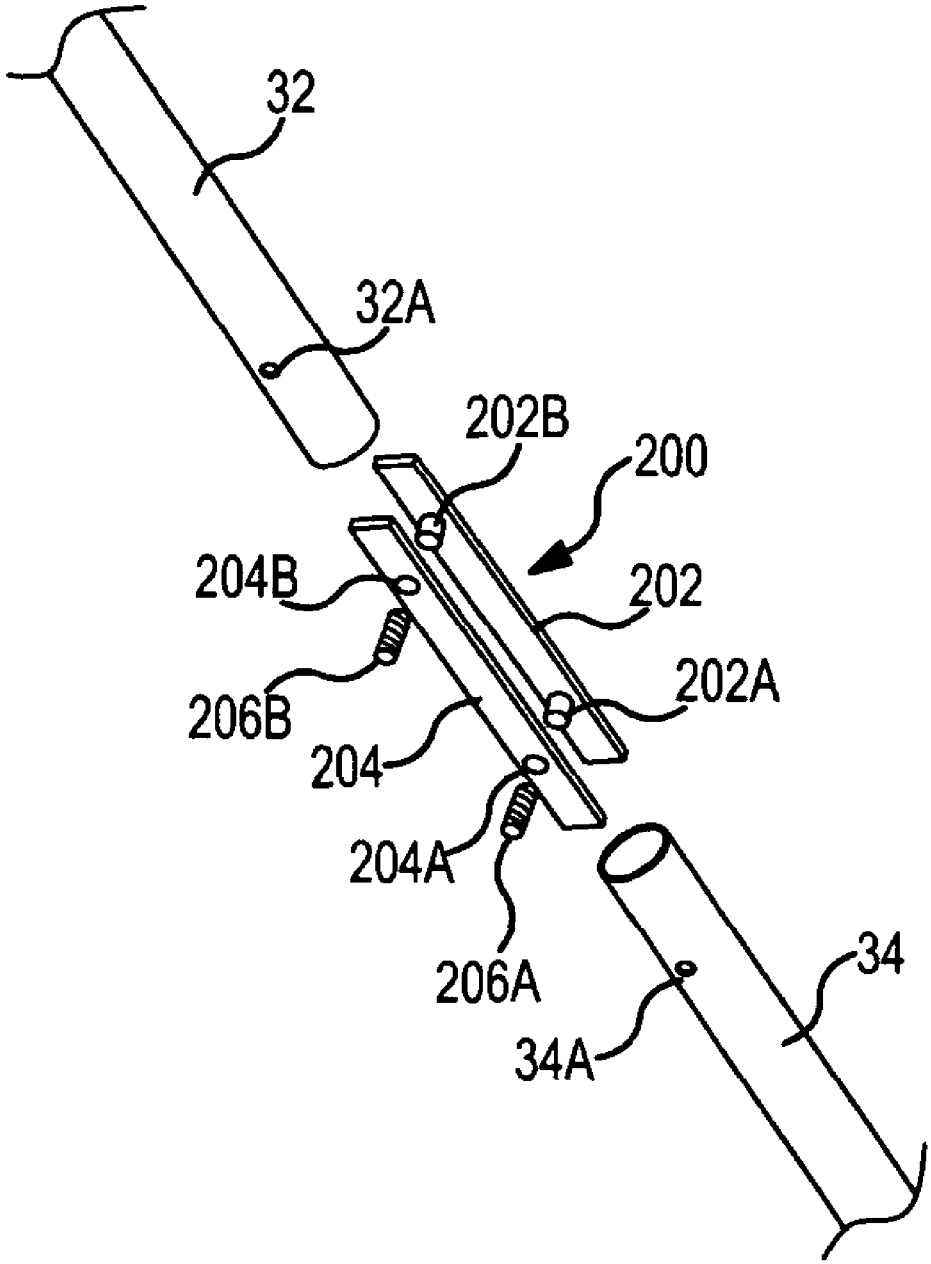
FIG. 6 is a magnified perspective view of the portion of the rear support structure indicated by zone C in FIG. 4B.
Figure 7:
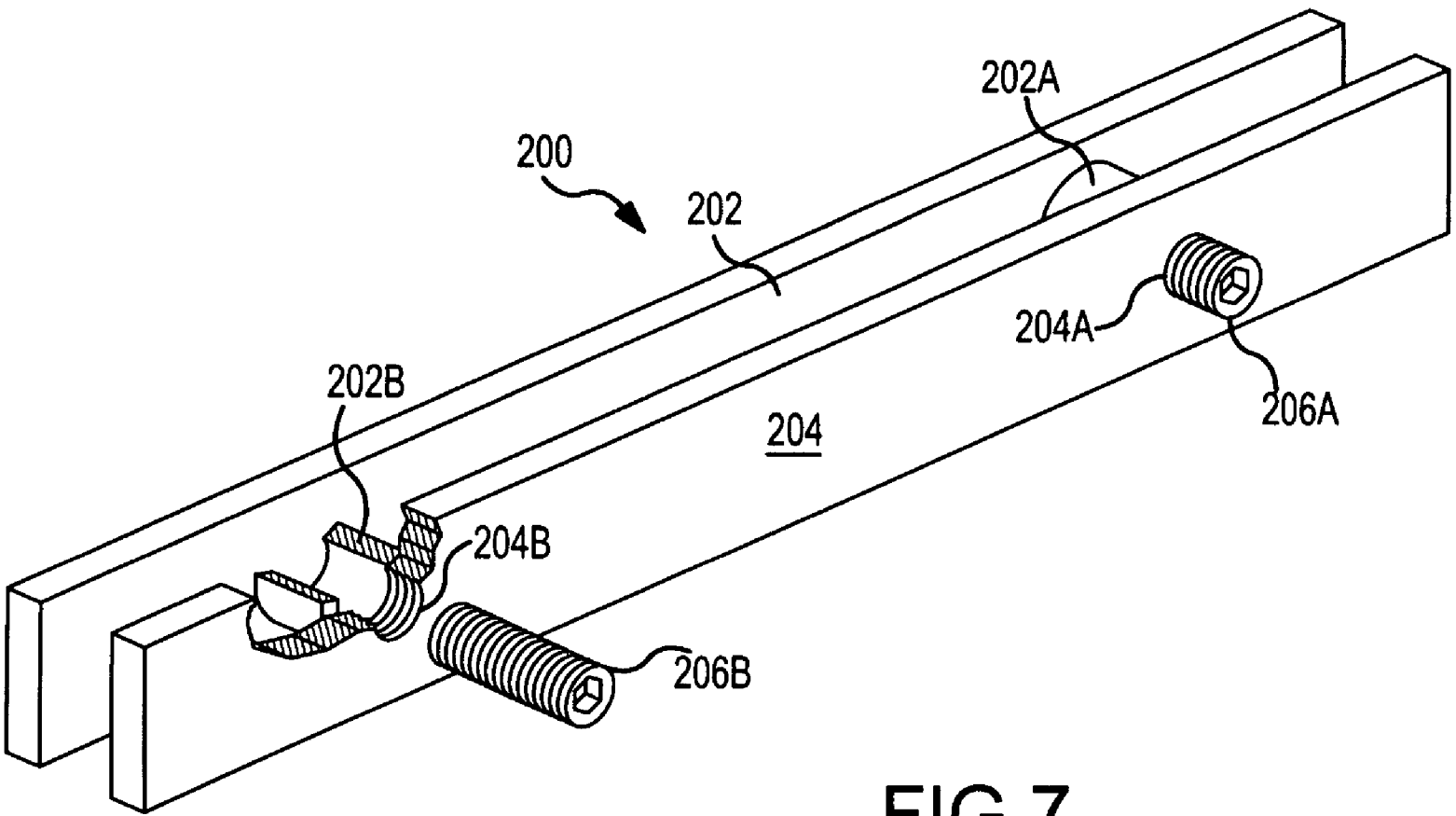
FIG. 7 is a magnified, partially cut away perspective view of the pressure assembly shown in FIG. 6 which is used to join relatively small diameter sections of tube used to construct the rear support structure of the soccer goal.

The arrangement of right and left support braces 30A and 30B are shown in FIGS. 1, 5A and 5B. Support braces 30A and 30B are generally identical, so only right support brace 30A is shown in FIGS. 5A and 5B. Brace 30A includes an upper member 32, a diagonal member 34, a corner member 36 and a lower member 38. Upper member 32 and lower member 38 are joined to the front portion 20 of goal structure 10 by joints which are substantially identical to the one illustrated between upper member 32 and connecting collar 42 shown in FIG. 4. Upper member 32, diagonal member 34, corner member 36 and lower member 38 are all connected to each other using a small pressure assembly 200 which is illustrated in greater detail in FIGS. 6 and 7. Small pressure assembly 200 includes a first pressure plate 202 and a second pressure plate 204. First pressure plate 202 includes a pair of spaced collars 202A and 202B which are open at one end and closed at the other end. Second pressure plate 204 has two correspondingly spaced threaded holes 204A and 204B. Threaded inserts 206A and 206B are threaded into holes 204A and 204B for engaging and pushing against the closed ends inside spaced collars 202A and 202B and thus push pressure plates 202 and 204 from a first contracted position to a second expanded position for applying pressure against the inside walls of joined upper member 32 and diagonal member 34. As is the case with pressure assembly 100, upper member 32 and diagonal member 34 include spaced tool holes 32A and 32B for providing access to threaded inserts 206A and 206B. The tube sections may be fashioned from aluminum. A preferred material for the various components of small pressure assembly 200 would be a strong, tough material such as steel. This tube joining arrangement allows for the disassembly of brace support 30A and also allows for the replacement of diagonal member 34 and lower member 38 with members having different lengths for accommodate different goal heights.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A soccer goal structure, comprising;

(a) a forward frame portion including a left upright member, a right upright member, at least one horizontal member spanning between the upper ends of the left and right upright members and corner fittings for joining the upper ends of the right and left upright members to the horizontal member, the left and right upright members and the horizontal member fashioned from generally identical tubing, the right and left upright members each having at least one tool hole spaced away from at least one of the open ends thereof, the at least one horizontal member having at least one tool hole spaced away from each of the two opposite ends thereof, the corner fittings including tubular legs which are fixed together to define a right angle, the tubular legs of the corner fittings presenting tubular ends which generally match the tubes of the left and right upright members and the at least one horizontal member, each tubular leg of each corner fitting having a tool hole spaced away from the open end thereof, the tool holes of the upright members and the horizontal members spaced away from their respective ends such that the spacing between the tool hole of a corner fitting leg and the tool hole of an upright member and between the tool hole of a corner fitting leg and the tool hole of a horizontal member is a generally common tool hole separation distance, the corner fittings further including connecting collars for receiving braces for supporting the forward frame portion, (b) pressure assemblies for joining the corner fittings, the upright members and the at least one horizontal member, each pressure assembly adapted for inserting into the matching open ends of the abutting tubular ends of corner fittings, upright members and the at least one horizontal member, the pressure assembly including a first pressure member and a second pressure member, the first pressure member having internally threaded bores which are spaced apart by a distance generally matching the tool hole separation distance, the threaded bores receiving threaded inserts which thread between a first retracted position and a second extended position for urging the first and second pressure members between a first contracted position to a second expanded position, the pressure assembly inserted into abutting ends of the tubes with the threaded inserts aligned with the tool holes of the tubes, the threaded inserts threaded from the first retracted position to the second extended position causing the pressure members to expand from a first contracted position to a second expanded position such that the pressure members apply sufficient pressure against the inside walls of the abutting tubes to join the tubes and wherein each corner fitting has tube section legs of unequal lengths, whereby, corner fittings may be oriented in one of two positions corresponding to one of two desired horizontal member heights so that tube sections and corner fittings may be arranged to construct a selected one of at least two soccer goal configurations having a selected one of at least two horizontal member heights, and, said horizontal member includes a right section, a left section and a center section which are joined together using said pressure assemblies, the center section interchangeable with a plurality of center sections of varying lengths in order to define a horizontal member having selected one of a plurality of lengths for constructing a selected sized soccer goal having selected one of a plurality of soccer goal widths.

2. The soccer goal structure of claim 1, wherein, the horizontal member includes a right section, a left section and a center section which are joined together using pressure assemblies, the center section interchangeable with a plurality of center sections of varying lengths in order to define a horizontal member having a selected one of a plurality of standard lengths for constructing a selected standard sized soccer goal.

3. The soccer goal structure of claim 1, wherein:

the first and second pressure members of each pressure assembly each include a center flange and two angled side flanges extending from opposite sides of the center flange, the two angled side flanges each presenting pressure surfaces for contacting the inside walls of the abutting tubes.

4. The soccer goal structure of claim 1, wherein:

the first and second pressure members of each pressure assembly each include a center flange and two side flanges extending from the center flange, the two angled side flanges each defining an obtuse angle with the center flange and presenting pressure surfaces for contacting the inside walls of the abutting tubes.

5. The soccer goal structure of claim 1, wherein:

the first pressure member of each pressure assembly includes a pair of internally threaded collars spaced apart by a distance corresponding to the tool hole spacing distance.

6. The soccer goal structure of claim 1, wherein:

the first pressure member of each pressure assembly includes a pair of internally threaded collars spaced apart by a distance corresponding to the tool hole spacing distance, wherein the second pressure member includes pins extending therefrom which are slidably received by the internally threaded collars of the first pressure member and wherein the threaded inserts when threaded between the first retracted position and the second extended position within the threaded collars cause the first and second pressure members to expand and contract between the first contracted position and the second expanded position.

7. The soccer goal structure of claim 1, wherein:

the first and second pressure members of each pressure assembly each include a center flange and two side flanges extending from the center flange, the two angled side flanges each defining an obtuse angle with the center flange and presenting pressure surfaces for contacting the inside walls of the abutting tubes, the first pressure member of each pressure assembly includes a pair of internally threaded collars extending from the center flange thereof, the threaded collars spaced apart by a distance corresponding to the tool hole spacing distance, the second pressure member of each pressure assembly includes pins extending from center flange thereof which are slidably received by the internally threaded collars of the first pressure member and wherein the threaded inserts when threaded between the first retracted position and the second extended position cause the first and second pressure members to expand and contract between the first contracted position and the second expanded position.

8. The soccer goal structure of claim 1, wherein:

the first and second pressure members of each pressure assembly each include a center flange and two side flanges extending from the center flange, the two angled side flanges each defining an obtuse angle with the center flange and presenting pressure surfaces for contacting the inside walls of the abutting tubes, the first pressure member of each pressure assembly includes a pair of internally threaded collars extending from the center flange thereof, the threaded collars spaced apart by a distance corresponding to the tool hole spacing distance, the second pressure member of each pressure assembly includes pins extending from center flange thereof which are slidably received by the internally threaded collars of the first pressure member and wherein the threaded inserts when threaded between the first retracted position and the second extended position cause the first and second pressure members to expand and contract between the first contracted position and the second expanded position, each corner fitting has tube section legs of unequal lengths, whereby, corner fittings may be oriented in one of two positions corresponding to one of two desired horizontal member heights so that tube sections and corner fittings may be arranged to construct a selected one of at least two standard soccer goal configurations having a selected one of at least two standard horizontal member heights, and, the horizontal member includes a right section, a left section and a center section which are joined together using pressure assemblies, the center section interchangeable with a plurality of center sections of varying lengths in order to define a horizontal member having a selected one of a plurality of standard lengths for constructing a selected standard sized soccer goal having a selected one of a plurality of standard soccer goal widths.

* * * * *